US005370309A

United States Patent [19]

Strelbisky et al.

[11] Patent Number: 5,370,309

[45] Date of Patent: Dec. 6, 1994

[54] LIQUID COOLED NOZZLE

[75] Inventors: Michael J. Strelbisky, Burlington; Thomas E. Langs, Ancaster, both of Canada

[73] Assignee: A. H. Tallman Bronze Company Limited, Burlington, Canada

[21] Appl. No.: 240,420

[22] Filed: May 10, 1994

Related U.S. Application Data

[63] Continuation of Ser. No. 63,593, May 19, 1993, abandoned.

[51] Int. Cl.[5] ..... B05B 15/00

[52] U.S. Cl. ..... 239/132.3

[58] Field of Search ..... 239/132.1, 132.3, 548

[56] References Cited

U.S. PATENT DOCUMENTS

| | | | |
|---|---|---|---|
| 1,468,370 | 9/1923 | Morse | 239/132.3 |
| 3,310,238 | 3/1967 | Bryant et al. | 239/132.3 X |
| 3,337,203 | 8/1967 | Smith et al. | 239/132.3 |
| 3,430,939 | 3/1969 | Berry | 239/132.3 |
| 3,559,974 | 2/1971 | Berry | 239/132.3 |
| 3,662,447 | 5/1972 | Schweng et al. | 239/132.3 X |
| 3,797,814 | 3/1974 | Rymachyk et al. | 239/132.3 X |
| 4,432,534 | 2/1984 | Zanetta et al. | 239/132.3 X |

FOREIGN PATENT DOCUMENTS

| | | | |
|---|---|---|---|
| 1261831 | 1/1972 | United Kingdom | 239/132.3 |

*Primary Examiner*—Andres Kashnikow
*Assistant Examiner*—Kevin Weldon
*Attorney, Agent, or Firm*—Rogers & Scott

[57] ABSTRACT

A liquid cooled nozzle for emitting a medium has a housing with a coolant inflow chamber having a first side wall for attachment to a coolant inflow pipe, and a coolant outflow chamber having a second side wall for attachment to a coolant outflow pipe and a base merging with the second side wall. The second wall is spaced from and surrounds the first wall, and the said base is spaced from the coolant inflow chamber and is beneath the coolant inflow chamber. At least two supply ports are provided for conducting the medium through the nozzle, the supply ports being laterally spaced from one another to define a central axis between the ports and extending through the coolant inflow chamber, the coolant outflow chamber and the base. At least one deflector is located between adjacent supply ports and terminates at a central passage extending from the coolant inflow chamber to the coolant outflow chamber. The deflector has an upper surface which is partially twisted to direct liquid coolant passing from the coolant passing from the coolant inflow chamber through the central passage into the coolant outflow chamber away from the central axis, thereby causing a swirling of the liquid coolant in the coolant outflow chamber.

11 Claims, 3 Drawing Sheets

FIG. 3
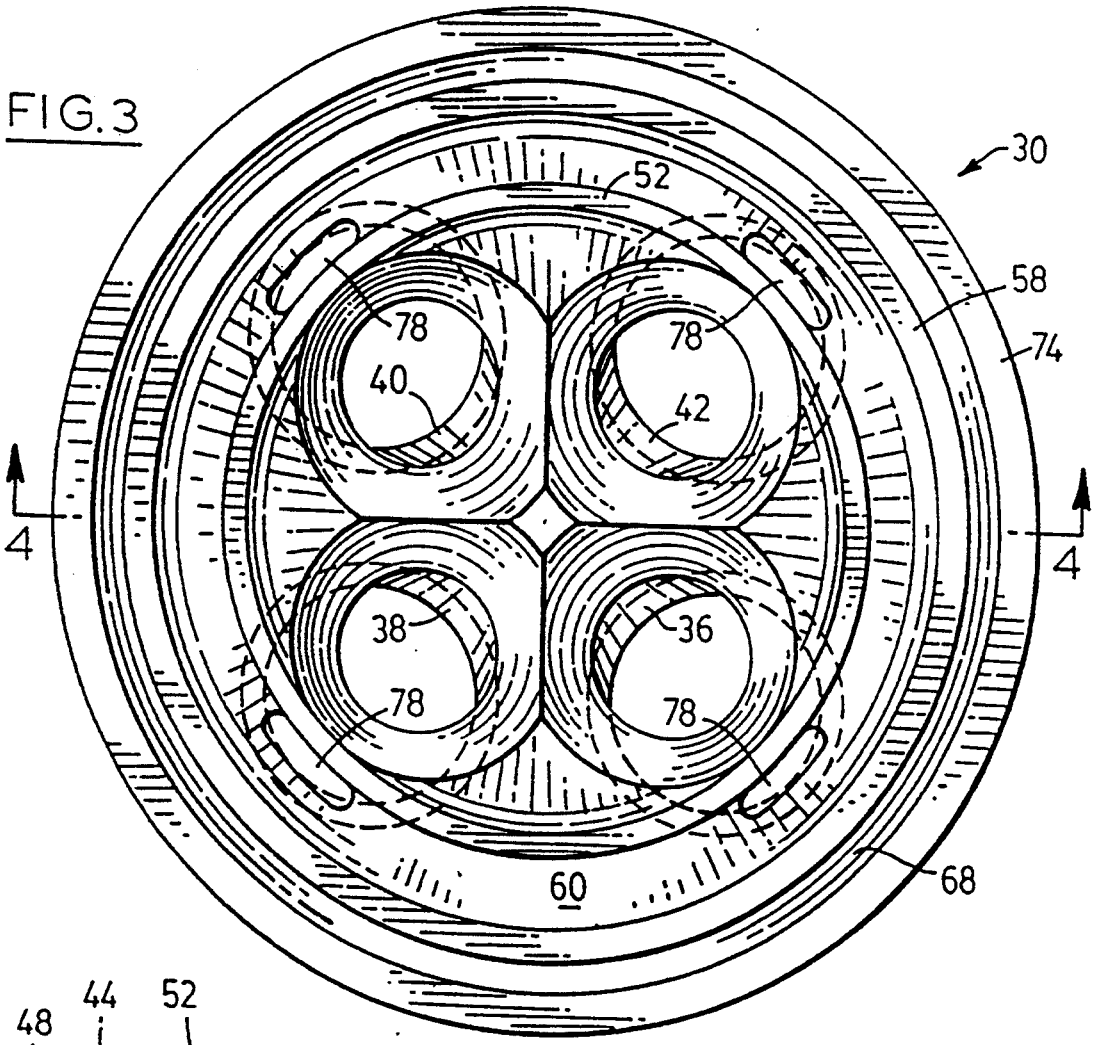
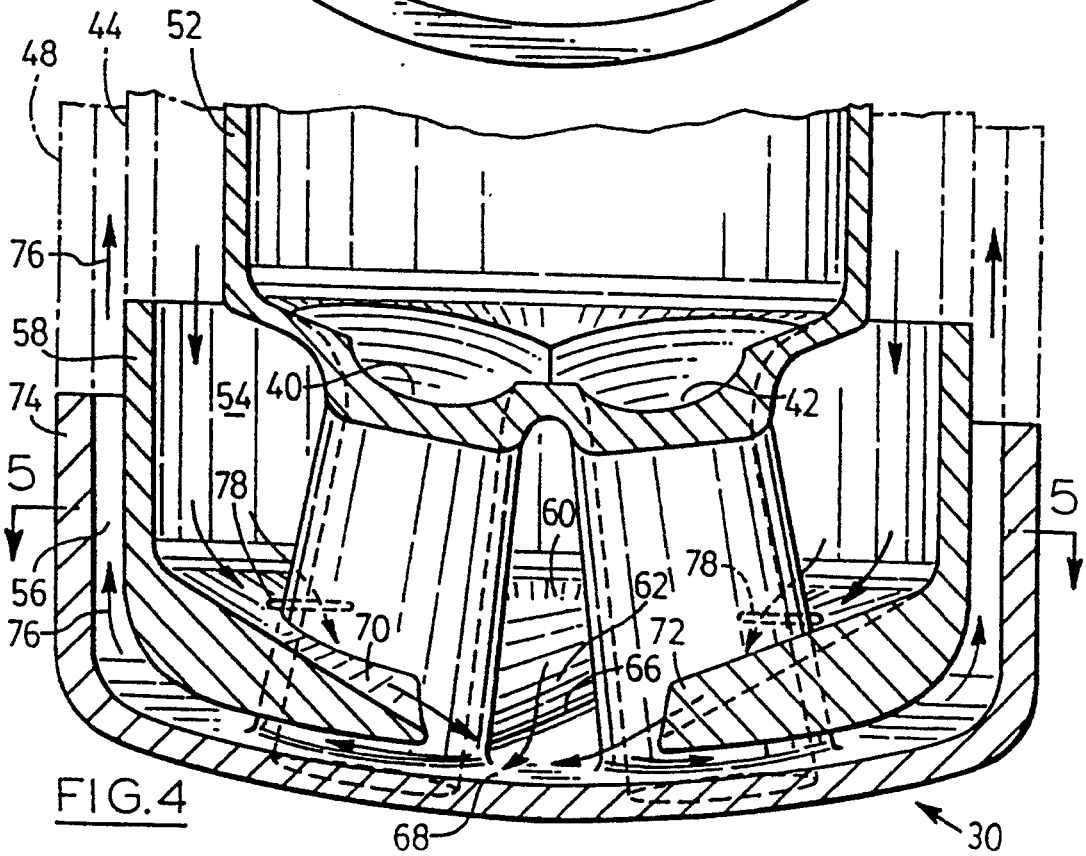
FIG. 4

LIQUID COOLED NOZZLE

This is a continuation of U.S. patent application Ser. No. 08/063,593 filed May 19, 1993 now abandoned.

This invention relates to liquid cooled nozzles and in particular to a liquid cooled nozzle which can be used in a heat environment such as in a basic oxygen steel making furnace.

1. Background of Invention

When making steel in a basic oxygen furnace, oxygen is blown into a molten metal bath at speeds commonly reaching Mach 2.2 in order to reduce main impurities in the charge and produce the desired chemical and metallurgical properties.

To introduce the oxygen into the molten metal, a lance is lowered into the furnace to a position just above the level of molten metal. A supply pipe extends through the centre of the lance for directing the oxygen to the tip of the lance above the molten metal. At the tip, a nozzle connects the supply pipe to several oxygen outlet ports specially designed to distribute the oxygen in a desirable manner in the furnace. It is important that the shape of the ports, often based on a venturi design, be maintained for proper oxygen penetration of the bath.

The temperature in a blast furnace can exceed 5,000 F. and occasionally the lance tip is inadvertently lowered into the molten metal. Therefore, cooling of the nozzle at the lance tip is very important to extend the life of the nozzle. The nozzle is usually although not necessarily made as a copper casting. Various alloys and coatings have been used to increase the life of the nozzle but often this has the adverse effect of reducing the thermal conductivity in the nozzle, thus leading to a shortened nozzle life.

It has been found that one of the best coolants is water. The lance usually has a pair of coolant pipes coaxial with and surrounding the oxygen pipe. With this arrangement, water flows through the inner coolant pipe and outside of the oxygen pipe to the tip of the lance. At the nozzle, the water removes heat from the nozzle and is directed upwardly through the outer coolant pipe.

2. Description of Prior Art

Prior art nozzles tend to wear on the bottom surface of the nozzle facing the molten metal and specifically on the bottom surface around the oxygen outlet ports. Typically, during cooling, the coolant water entering the nozzle passes from the coolant inflow pipe and around the oxygen ports to the middle of the nozzle. This creates a stagnant body of water which reduces cooling efficiency. Prior art inventions, in an attempt to extend the life of a nozzle and address the cooling problems, have concentrated on features located inside the nozzle on the bottom surface. For example, a centrally located nipple may be provided to increase the material thickness, thereby reducing the effects of material wear. Some nozzles have a wall positioned in the centre to break up the inflow of coolant water. Cooling fins have been provided inside the nozzle on the bottom surface to attempt to distribute heat. However by adding material in this central portion, heat transfer is actually reduced. Further, providing a wall in a substantially stagnant body of water will have little effect. In fact, a wall will most likely reduce the coolant flow through the central portion as also will cooling fins.

When using a nozzle in a steel making furnace, the nozzle has to be removed from the lance and replaced if the dimensions of the nozzle are substantially changed by the harsh conditions. Depending on operating conditions, a nozzle on a lance tip tends to last about 100 to 200 heats or about 1 to 2 weeks. It can take anywhere from 2 hours to 1 day to change the nozzle. Operating with a faulty nozzle can produce a poor quality steel as well as possibly damaging the furnace refractory by incorrectly aiming the stream of oxygen.

SUMMARY OF INVENTION

It is an object of the invention to provide an improved liquid cooled nozzle which can be used in a heated environment such as a steel making furnace.

It is a further object of the invention to minimize the amount of stagnant coolant liquid between the oxygen ports, in a liquid cooled nozzle, thereby increasing the efficiency of the cooling in the nozzle.

According to the present invention, a liquid cooled nozzle for emitting a medium comprises a housing having a coolant inflow chamber having a first side wall for attachment to a coolant inflow pipe, a coolant outflow chamber having a second side wall for attachment to a coolant outflow pipe and a base merging with the second side wall, the second side wall being spaced from and surrounding the first side wall, and the base being spaced from the coolant inflow chamber and being beneath the coolant inflow chamber, at least two supply ports for conducting the medium through the nozzle, the supply ports being laterally spaced from one another to define a central axis between the ports and extending through the coolant inflow chamber, the coolant outflow chamber and the base, and at least one deflector located between adjacent supply ports and terminating at a central passage extending from the coolant inflow chamber to the coolant outflow chamber, the deflector having an upper surface which is partially twisted to direct liquid coolant passing from the coolant inflow chamber through the central passage into the coolant outflow chamber away from the central axis, thereby causing a swirling of the liquid coolant in the coolant outflow chamber.

The coolant inflow chamber may have a floor which defines the at least one deflector. The twist may be in the range of from about 20° to about 35°, for example about 30°. The upper surface of each deflector may slope downwardly towards a centre portion of the base. The slope may be in the range of from about 5° to about 50°, for example about 25°.

The supply ports may be arranged in a ring configuration. There may for example be four supply ports and four deflectors, the four deflectors terminating at the passage to the coolant outflow chamber. The housing may be a copper casting.

DESCRIPTION OF A PREFERRED EMBODIMENT

One embodiment of the invention will now be described, by way of example, with reference to the accompanying drawings, of which:

FIG. 3 is a top plan view of the nozzle of FIG. 2;

FIG. 4 is a sectional view taken along line 4—4 of FIG. 3 showing the flow of coolant through the nozzle.

Figure 1:
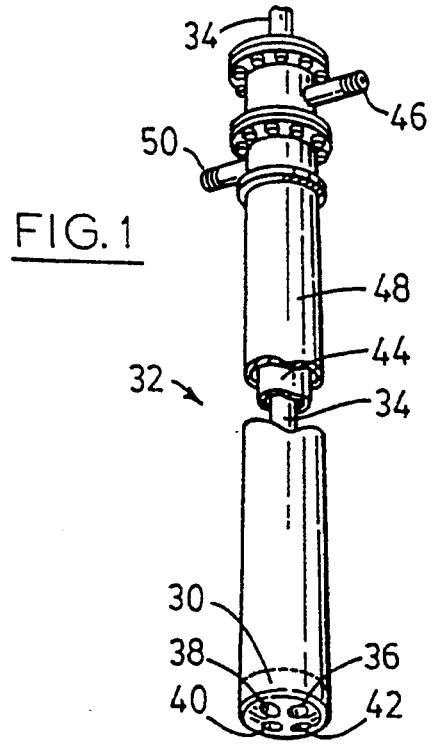
FIG. 1 is a simplified perspective view of a steel making furnace lance having a nozzle, in accordance with the invention mounted on its tip.

Referring to the drawings, FIG. 1 shows a nozzle 30 mounted on the tip of a lance 32, of a type commonly used in a basic oxygen steel making furnace to blow oxygen into a molten metal bath. An oxygen supply pipe 34 conducts the oxygen axially and centrally through the lance to the nozzle 30 where it is divided and exits through four exit ports 36, 38, 40 and 42. A person skilled in the art will readily appreciate that there may be more or less than four ports if desired.

A coolant liquid, usually water, is used to cool the nozzle and enters a coolant inflow pipe 44 through inlet 46, the coolant inflow pipe 44 being coaxial with the surrounding the oxygen supply pipe 34, Heat is transferred from the nozzle 30 to the coolant water as the water flows into the nozzle 30 through pipe 44. The water passes through the nozzle 30 and upwardly through a coolant outflow pipe 48 which is coaxial with and surrounds the coolant inflow pipe 44. Finally, the water flows through outlet 50.

Figure 2:
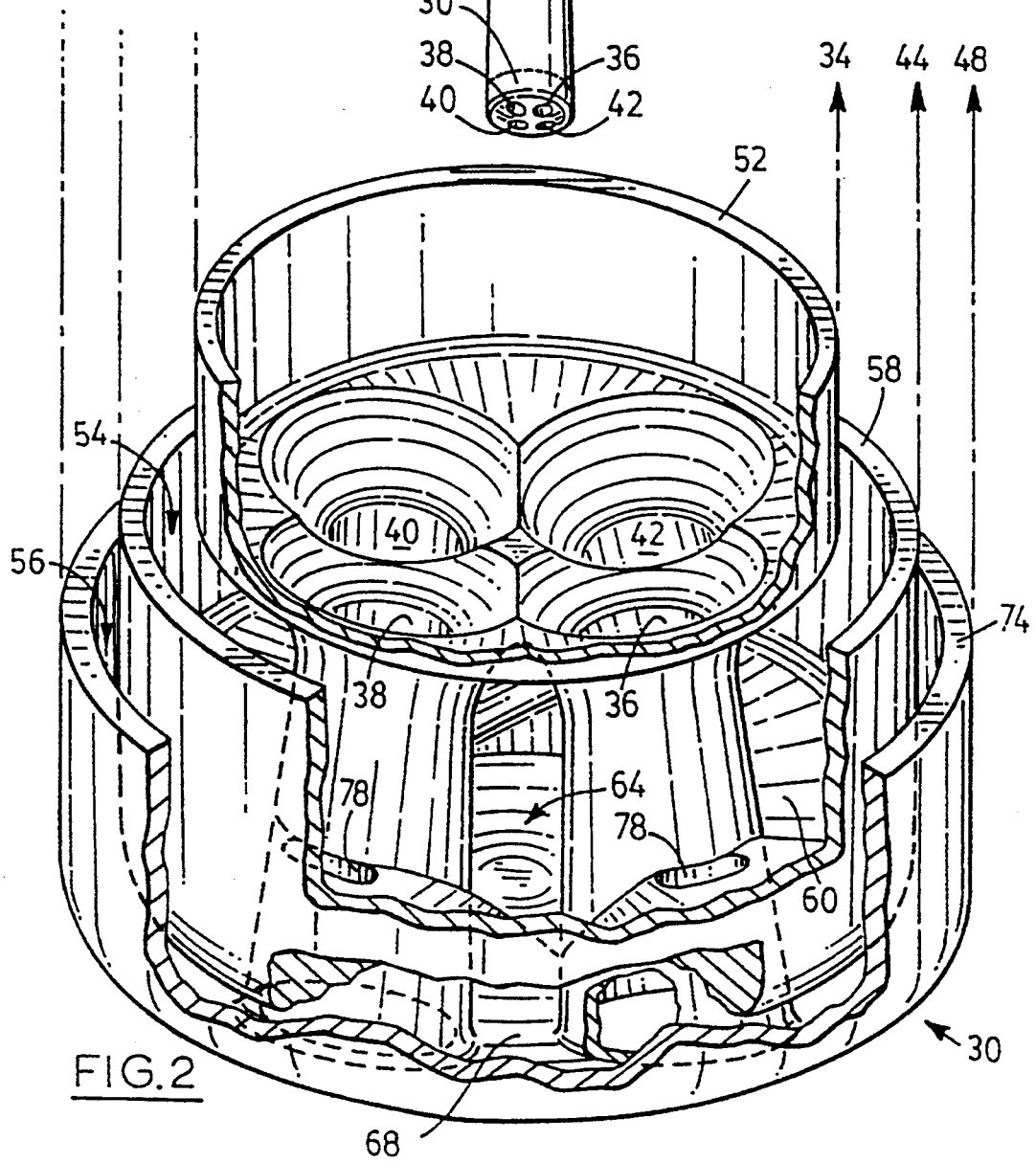
FIG. 2 is a partially cut away simplified perspective view of the nozzle.

The nozzle 30 comprises a housing formed as a copper casting and, as shown in FIG. 2, the oxygen ports 36, 38, 40 and 42 are radially spaced from one another and extend from a manifold 52 which is attachable in known manner to the supply pipe 34 shown in FIG. 1. The nozzle 30 has a coolant inflow chamber 54 into which water flows from the inflow pipe 44, and a coolant outflow chamber 56 below and radially surrounding the coolant inflow chamber 54 and through which water passes before being removed from the nozzle 30 through the outflow pipe 48.

The coolant inflow chamber 54 has a side wall 58 for attachment by welding to coolant inflow pipe 44. The side wall 58 surrounds the oxygen ports 36, 38, 40, 42 and merges at its lower end with a floor 60 through which the oxygen ports 36, 38, 40, 42 pass. Between adjacent pair of oxygen ports 40, 42, the floor 60 defines a deflector 62 which terminates at a central passage 64 into the coolant outflow chamber 56. Similar deflectors are located between the other adjacent pairs of oxygen ports, as will be described, and are used to guide the liquid from the coolant inflow chamber 54 through the passage 64 into the coolant outflow chamber 56.

Each deflector has an upper surface with a partial twist as illustrated in FIG. 4 so that the coolant water will be guided to one side as it flows over the deflector. The purpose of the twist is to avoid the formation of a stagnant body of water in the centre of the nozzle 30 between the oxygen ports 36, 38, 40 and 42. The angle of twist is preferably in the range of from about 15° to about 40°, and more preferably about 30°. The angle of the twist is measured from the angle that an edge 66 of the upper surface of the deflector 62 makes with the horizontal, in this case the floor 60.

As well as the deflector surfaces being partially twisted, the deflector surfaces also slope downwardly towards a centre portion of the base 68 of the coolant outflow chamber 56. The slope is illustrated by deflectors 70 and 72 in FIG. 4 and is preferably in the range of about 5° to about 50° and more preferably about 25°. The slope aids in directing the water through the passage 64 into the coolant outflow chamber 56.

From the coolant outflow chamber 56, the water flows upwardly between an outer side wall 74 of the coolant outflow chamber 56 and the side wall 58 of the coolant inflow chamber 54, following arrows 76, to the fluid outflow pipe 48 shown in FIG. 1. The water entering the coolant inflow chamber 54 also passes through slots 78 in the floor 60 in to the coolant outflow chamber 56. The slots 78 are shown more clearly in FIG. 3 to be outside and adjacent to the supply ports 36, 38, 40 and 42. The slots 78 and the passage 64 are on the opposite sides of the respective oxygen port. The slots 78 help cool the nozzle in the location behind the ports.

Figure 5:
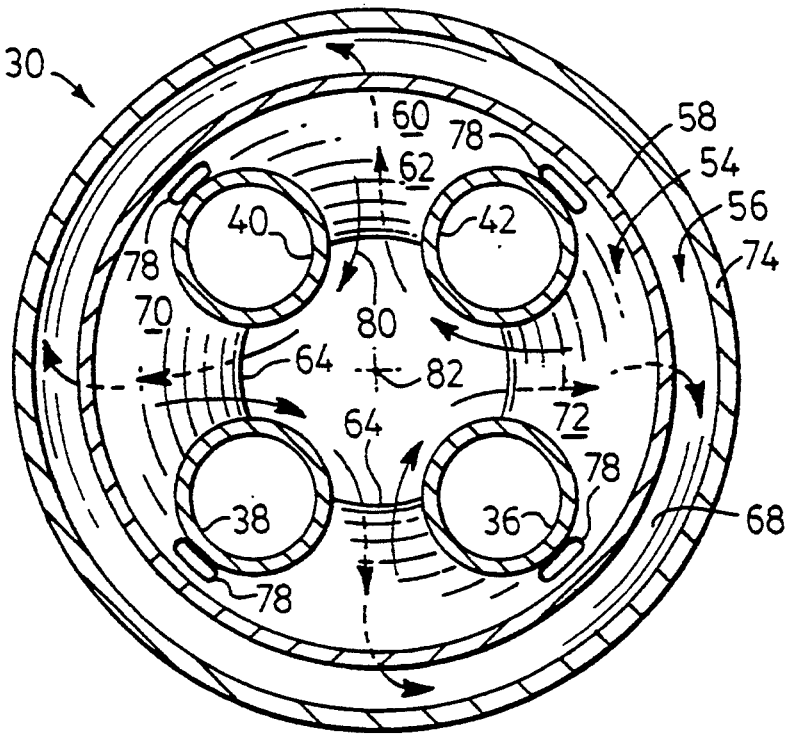
FIG. 5 is a schematic sectional plan view taken along line 5—5 of FIG. 4 showing the flow of coolant through the nozzle.

In use, as shown in FIG. 5, the water between oxygen ports 40 and 42 flows down the coolant inflow pipe 58 (into the page as drawn) and is directed by the upper surface of longitudinal deflector 62 to follow the path of arrow 80 away from a central longitudinal axis 82 which extends axially between the supply ports 36, 38, 40 and 42. The water then passes between oxygen ports 38 and 40 through the passage 64 and across the base 68 below the deflector 70 before leaving the nozzle 30 through the coolant outflow pipe 74. While passing through the nozzle, the water cools the base 68 which absorbs heat from the furnace at the location between oxygen ports 38, 40. Similarly, the water directed by the twist of the upper surface of deflector 70 between oxygen ports 38 and 40 will pass between oxygen ports 36 and 38 across the base 68 of the nozzle 30 and out through pipe 74.

In summary, the water is guided by the upper surface of each deflector away from the central axis 82 and substantially between an adjacent pair of adjacent supply ports when in the coolant outflow chamber 56. This creates a swirling effect in the nozzle and avoids a stagnant body of water at the central axis 82. Heat transfer is aided because the water passing between adjacent pair of supply ports is directed away from the water passing between an opposing pair of adjacent supply ports.

It will be evident that the invention applies to nozzles having fewer or more than four oxygen supply poets. As in the illustrated embodiment, the upper surface of each deflector would be partially twisted to guide the coolant liquid in a given direction to effect a swirl-like action in the centre between the supply ports.

While the preferred embodiment of the invention has been described as applied a nozzle on the end of a lance tip for a basic oxygen blast furnace, the invention has other applications where a nozzle requires a liquid coolant. Further, the coolant outflow chamber could direct the coolant liquid through a side mounted coolant outflow pipe rather than upwardly through the coaxial coolant outflow pipe described and shown in the preferred embodiment.

Other embodiments of the invention will be readily apparent to a person skilled in the art, the scope of the invention being defined by the following claims.

We claim:

1. A liquid cooled nozzle for emitting a medium comprising a housing having:

a coolant inflow chamber having a first side wall for attachment to a coolant inflow pipe;

a coolant outflow chamber having a second side wall for attachment to a coolant outflow pipe and a base merging with said second side wall, said second wall being spaced from and surrounding the first wall, and said base being spaced from the coolant inflow chamber and being beneath the coolant inflow chamber;

at least two supply ports for conducting the medium through the nozzle, said supply ports being laterally spaced from one another to define a central axis between said ports and extending through the coolant inflow chamber, the coolant outflow chamber and the base; and at least one deflector located between adjacent supply ports and terminating at a central passage extending from the coolant inflow chamber to the coolant outflow chamber, the deflector having an upper surface which is partially twisted and downwardly sloped to direct liquid coolant passing from the coolant inflow chamber through said central passage into the coolant outflow chamber away from the said axis, and substantially between an adjacent pair of supply ports thereby causing swirling of said liquid coolant in the coolant outflow chamber.

2. A nozzle as claimed in claim 1 wherein the coolant inflow chamber has a floor which defines said at least one deflector.

3. A nozzle as claimed in claim 1 wherein said twist is in the range of from about 20° to about 35°.

4. A nozzle as claimed in claim 3 wherein said twist is about 30°.

5. A nozzle as claimed in claim 1 wherein the upper surface of each deflector slopes downwardly towards the centre portion of said base.

6. A nozzle as claimed in claim 5 wherein the upper surface of each deflector slopes downwardly towards a centre portion of the base at an angle in the range of from about 5° to about 50°.

7. A nozzle as claimed in claim 6 wherein said slope is about 25°.

8. A nozzle as claimed in claim 3 wherein the upper surface of each deflector slopes downwardly towards a centre portion of the base at an angle in the range of from about 5° to about 50°.

9. A nozzle as claimed in claim 1 wherein the supply ports are arranged substantially in a ring configuration.

10. A nozzle as claimed in claim 9 wherein there are four supply ports and four deflectors, said four deflectors terminating at said passage to the coolant outflow chamber.

11. A nozzle as claimed in claim 1 wherein the housing is a copper casting.

* * * * *